US007175368B2

(12) United States Patent
Stötzer

(10) Patent No.: US 7,175,368 B2
(45) Date of Patent: Feb. 13, 2007

(54) METHOD AND TEST SETUP FOR DETERMINING THE BEARING BEHAVIOUR OF DISPLACEMENT PILES

(75) Inventor: Erwin Emil Stötzer, Aïchach (DE)

(73) Assignee: Bauer Maschinen GmbH, Schrobenhausen (DE)

( * ) Notice: Subject to any disclaimer, the term of this patent is extended or adjusted under 35 U.S.C. 154(b) by 0 days.

(21) Appl. No.: 10/947,198

(22) Filed: Sep. 23, 2004

(65) Prior Publication Data

US 2005/0074297 A1 Apr. 7, 2005

(30) Foreign Application Priority Data

Oct. 2, 2003 (DE) ..... 103 46 040

(51) Int. Cl.
*G01N 3/00* (2006.01)

(52) U.S. Cl. ..... 405/232; 73/84; 405/256

(58) Field of Classification Search ..... 73/84; 405/231, 232, 233, 248, 256
See application file for complete search history.

(56) References Cited

U.S. PATENT DOCUMENTS 3,946,601 A 3/1976 Yizhaki ..... 73/84
4,081,992 A * 4/1978 Aurora et al. ..... 73/84
5,234,290 A * 8/1993 Collins ..... 405/249
6,363,776 B1 * 4/2002 Reinert, Sr. ..... 73/84
6,983,643 B2 * 1/2006 Brighton et al. ..... 73/81

FOREIGN PATENT DOCUMENTS

DE 24 34 054 2/1975
DE 40 05 032 A1 8/1991
DE 42 28 580 C1 9/1992

OTHER PUBLICATIONS

"Bautechnik," 69/1992, S. 728.

* cited by examiner

*Primary Examiner*—Thomas B. Will
*Assistant Examiner*—Tara L. Mayo
(74) *Attorney, Agent, or Firm*—Jacobson Holman PLLC

(57) ABSTRACT

The invention relates to a method and a test setup for determining the bearing behaviour of displacement piles. The displacement piles are produced by making a hole using a displacement head and subsequently filling the hole with a hardenable suspension, whilst leaving the displacement head in the hole. The resulting test pile is subject to the action of a test load using a loading device and the bearing behaviour is measured by a measuring device. An efficient test performance results from the fact that the displacement head is introduced into the ground by means of a metallic pile string, which forms part of the test pile.

12 Claims, 1 Drawing Sheet

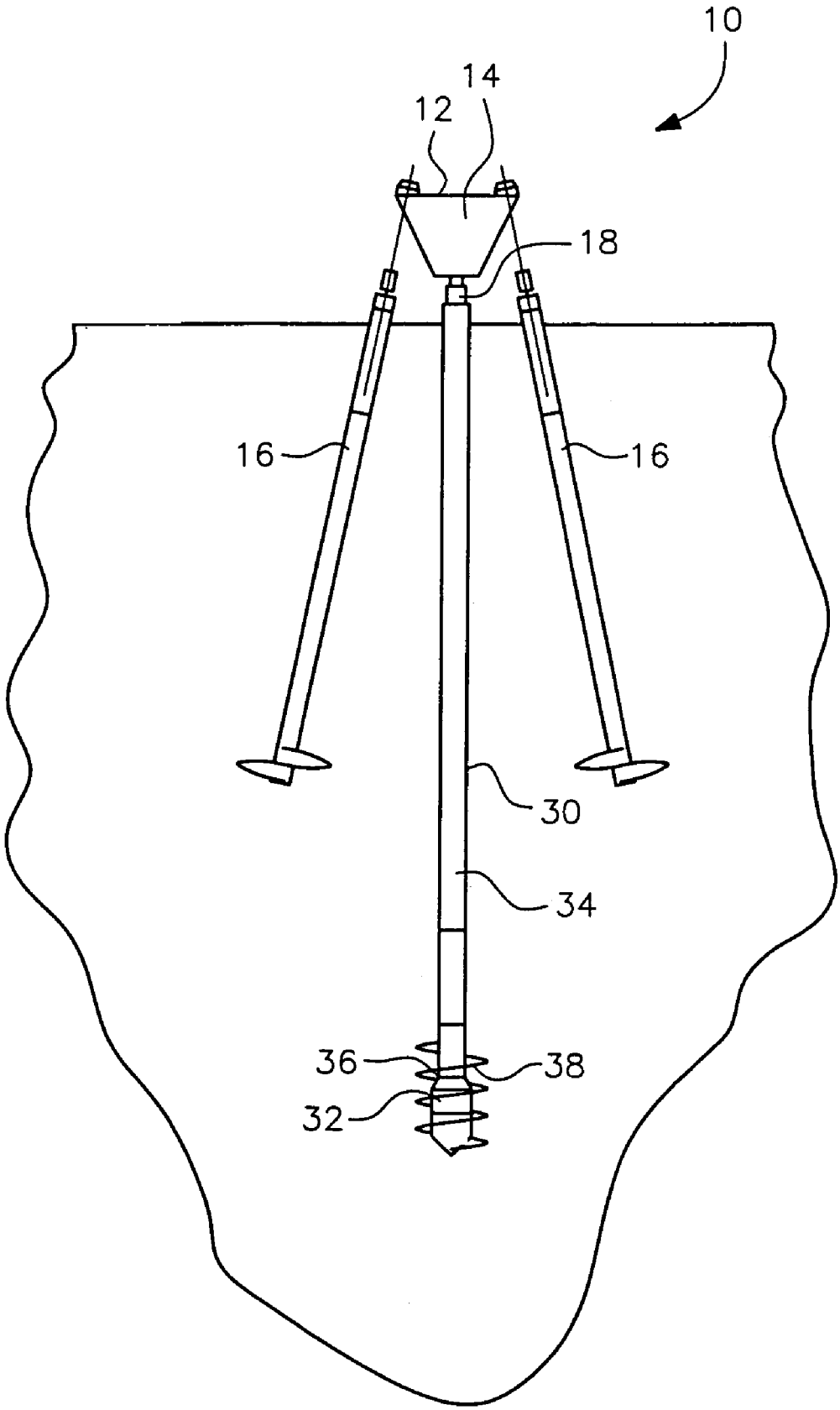
10
14
12
18
16
16
30
34
36
38
32

METHOD AND TEST SETUP FOR DETERMINING THE BEARING BEHAVIOUR OF DISPLACEMENT PILES

BACKGROUND OF THE INVENTION

The invention relates to a method for determining the bearing behaviour of displacement piles, which are made by forming a hole by means of a displacing or displacement head and subsequent filling of the hole with a hardenable suspension, while leaving the displacement head in the hole, a test pile being installed and subject to a test load by means of a loading device, the bearing behaviour being measured by a measuring device. The invention also relates to a test setup for determining the bearing behaviour of displacement piles.

It is in many cases necessary for ensuring an adequate bearing capacity when setting up structures to introduce foundation piles into the ground. The bearing capacity of an individual foundation pile is decisively dependent on local soil conditions, so that the bearing behaviour of foundation piles can scarcely be reliably determined using purely theoretical calculations.

It is therefore necessary in many cases for determining the actual bearing behaviour of a displacement pile, to install one or more test piles in the building site. These test piles can then be subject to a predetermined test load and then the corresponding bearing behaviour, particularly settlement of the pile can be measured. For this purpose the test pile is subject to the action of a loading device exerting a predetermined pressure on said test pile. It is necessary in the case of concrete piles for the concrete to have already set and hardened. However, this can last several weeks, so that the determination of the actual bearing behaviour from the start of pile introduction to the end of the test takes up a very considerable amount of time.

SUMMARY OF THE INVENTION

The object of the invention is to provide a method and a test setup for determining the bearing behaviour of concrete displacement piles with a displacement head with which the bearing behaviour of such displacement piles can be particularly rapidly and economically established.

The method according to the invention is characterized in that the displacement head is introduced into the ground by means of a metallic pile string, which, together with the displacement head, forms the test pile.

The invention is based on the finding that in the case of displacement piles with a so-called leave in place displacement head, the bearing behaviour is decisively determined by the displacement head. According to the invention the displacement head is introduced directly in the ground by a pile string which, together with the displacement head, forms the test pile. The diameter and length of the pile string are in this way adapted to the displacement pile formed from the hardened suspension, particularly concrete. The displacement head can be made from metal, concrete or some other suitable material. Unlike in the case of, for example, a concrete pile, with the test method according to the invention the test loading can take place directly following the introduction of the pile string with the displacement head into the ground, which saves time and money.

Since, according to the invention the bearing behaviour of a displacement pile with a leave in place displacement head is determined decisively by the base surface of the displacement head and only to a lesser degree by the friction along the circumference of the pile with the ground, the bearing behaviour test values determined during the test can be directly transferred to the bearing behaviour of actual displacement piles. As a result of the higher friction factor between the ground and the concrete compared with the friction factor between metal and the ground, with a direct transfer of the results there is even an additional safety factor for the actual displacement piles.

According to the invention a particularly precise determination of the bearing behaviour can be obtained in that the values established by the measuring devices for the metallic test pile can be converted by means of a correction factor and in accordance with the characteristics of the displacement piles from the hardened suspension.

For an efficient introduction of the test load, according to the invention at the upper end of the metallic pile string is provided a load distributing head, which transfers the test load to the pile string. At its upper end the pile string can have a connecting device to which the load distributing head or a pressing device can be easily fixed.

This is further developed in a preferred manner by at least two anchor elements being introduced around the test pile into the ground and the load distributing head being connected with the anchor elements for force dissipation purposes. The anchor elements can in particular be screw anchors, of which the necessary numbers are screwed into the ground at a particular setting angle to the test pile. The load distributing head is then braced with the screw anchors, so that a compressive force can be exerted on the test pile.

According to the invention, a pressing device used for producing the test loading is placed between the pile string and the load distributing head for producing a clearly defined load profile. The pressing device can in particular be a hydraulic compressive cylinder producing the desired compressive force on moving apart between the load distributing head and the test pile.

Compared with other conventional concrete test piles, the advantage of the method according to the invention is that, following the measurement, the pile string with or without the displacement head can be removed from the ground. Thus, following the test, the pile string and displacement head can be reused.

Due to the long testing period in the case of conventional testing methods, the latter were carried out at a remote location of the building site so as not to unnecessarily hinder the continuation of the construction work. According to a preferred embodiment of the invention the displacement head remains in the ground and on removing the pile string the hardenable suspension is introduced. The pile string is detachably coupled to the displacement head, for example, by a thread. Following the test, the test pile can easily be converted into a displacement pile carrying or bearing the structure. The test pile can be directly implemented at the location of a bearing pile. It is obviously also possible for the test pile to remain in the ground together with the metallic pile string and then carries the structure together with the further concrete displacement piles to be made.

According to another preferred embodiment of the invention the pile string is a cylindrical element, particularly a tube, whose outer surface is modified for increasing a friction factor with the ground. For example, the outer surface of the pile string can be roughed or equipped with profile elements, such as screw spirals. As a result the friction factor can be adapted to an empirical friction factor between a concrete pile and the ground.

The invention also relates to a test setup for determining the bearing behaviour of a displacement pile with a displacement head, comprising a loading device for applying a test load. The test setup according to the invention is characterized in that a metallic pile string is provided and to its lower end is detachably fixed a displacement head and to its upper end a loading device. The aforementioned method can in particular be performed with this test setup and the advantages associated therewith are obtained. The measuring device can be integrated into the pile string or into the loading device. It is alternatively possible to separately connect a mobile measuring device.

The invention is described in greater detail hereinafter relative to a preferred embodiment diagrammatically shown in the single drawing, which is a diagrammatic side view of a test setup for determining the bearing behaviour of displacement piles.

DETAILED DESCRIPTION OF THE INVENTION

With reference to the test setup 10 according to the invention a test pile 30 is driven into the zonally represented ground with a displacement head 32, which displaces the soil in the surrounding ground area. Apart from the displacement head 32, the test pile 30 has a metallic pile string 34 detachably connected to the displacement head 32 by means of a connecting device 36. With regards to its length and diameter the test pile 30 corresponds to actual displacement piles made from concrete.

Above ground level a loading device 12 with a load distributing head 14 and a hydraulic pressing device 18 are located on the test pile 30. For force dissipation purposes the load distributing head is coupled with anchor elements 16 laterally screwed in with a predetermined setting angle. Using the pressing device 18 a predetermined test load is applied to the test pile 30. During and/or after load application and using a not shown measuring device the bearing behaviour, particularly the settlement of the test pile 30 is measured. According to the invention, the settlement behaviour of the test pile 30 with metallic pile string corresponds with surprisingly high precision to the settlement behaviour of a concrete displacement pile. For matching the friction coefficient of the metallic pile string 34 to a concrete pillar, it is possible to have profile elements 38 in the form of spirals along the pile string 34.

At the end of testing, the tubular pile string 34 can be released from the displacement head 32, by rotating in the opposite direction and can be extracted from the tube. Simultaneously with the extraction movement, the resulting cavity can be filled with a hardenable suspension, particularly concrete. In this way the metallic test pile can be readily transformed into a concrete pile, which can then be used for the foundations of the structure.

The invention claimed is:

1. A method for determining the bearing behavior of a displacement pile that is made by forming a hole in the ground by a displacement head and subsequent filling of the hole with a hardenable suspension while leaving the displacement head in the hole, the method comprising the steps of:

using a metallic pile string attached to the displacement head to introduce the displacement head into the ground, the metallic pile string and displacement head thereby creating a test pile;

subjecting the test pile to a test load using a loading device; and measuring a value for the bearing behavior of the test pile by means of a measuring device; and converting the value measured by the measuring device to a value for the test pile by applying a correction factor corresponding to the characteristic of a known displacement pile made from the hardened suspension whereby the bearing behavior of the displacement pile is determined.

2. The method according to claim 1, further comprising the steps of:

positioning a load distributing head at the upper end of the metallic pile string, the load distributing head being used to transfer the test load to the metallic pile string.

3. The method according to claim 2, further comprising the steps of:

positioning at least two anchor elements avoid the test pile and introducing the at least two anchor elements into the ground; and connecting the load distributing head to the anchor elements for force dissipation purposes.

4. The method according to claim 2, further comprising the steps of:

positioning a pressing device between the pile string and the load distributing head, the pressing device used to produce the test load.

5. The method according to claim 1, further comprising the steps of:

following the measurement, removing the pile string from the ground with or without the displacement head.

6. The method according to claim 1, further comprising the steps of:

following the measurement, removing the pile string from the ground without the displacement head, wherein the displacement head remains in the ground; and introducing the hardenable suspension.

7. The method according to claim 1, wherein the pile string is a cylindrical element, particularly a tube, whose outer surface is modified for increasing a friction factor with the ground.

8. The method of claim 1 further comprising the step of providing profile elements on the metallic string to match the friction coefficient of the metallic pile to a concrete pillar.

9. The method of claim 8 wherein the profile elements on the metallic string are provided in the form of spirals.

10. The method of claim 8 wherein the pile string has an upper end that is fixed to the load distributing device.

11. The method of claim 8 wherein the pile string has an upper end that is fixed to the measuring device.

12. A test setup for determining the bearing behavior of a displacement pile that is made by forming a hole in the ground by a displacement head and subsequent filling of the hole with a hardenable suspension while leaving the displacement head in the hole or removing the displacement head from the hole, the test setup comprising:

an elongated metallic pile string having one end detachably attached to the displacement head to introduce the displacement head into the ground thereby creating a test pile;

a loading device attached to the other end of the pile string to provide a test load; and a measuring device for measuring a value of the bearing behavior of the test pile; and means for converting the value measured by the measuring device to a value for the test pile by applying a correction factor corresponding to the characteristic of a known displacement pile made from the hardened suspension whereby the bearing behavior of the displacement pile is determined.

* * * * *